US007665594B2

(12) United States Patent
Kikuchi et al.

(10) Patent No.: US 7,665,594 B2
(45) Date of Patent: Feb. 23, 2010

(54) PASSENGER CONVEYOR

(75) Inventors: Takayuki Kikuchi, Himeji (JP); Yoshinobu Ishikawa, Fuchu (JP); Yasuhiro Matsumoto, Fuchu (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 215 days.

(21) Appl. No.: 11/816,540

(22) PCT Filed: Feb. 17, 2006

(86) PCT No.: PCT/JP2006/302800

§ 371 (c)(1),
(2), (4) Date: Aug. 17, 2007

(87) PCT Pub. No.: WO2006/100851

PCT Pub. Date: Sep. 28, 2006

(65) Prior Publication Data

US 2009/0008216 A1 Jan. 8, 2009

(30) Foreign Application Priority Data

Mar. 23, 2005 (JP) ..... 2005-084652

(51) Int. Cl.
*B66B 23/02* (2006.01)

(52) U.S. Cl. ..... 198/330; 198/332

(58) Field of Classification Search ..... 198/321, 198/330, 332

See application file for complete search history.

(56) References Cited

U.S. PATENT DOCUMENTS 3,365,051 A * 1/1968 Mullis et al. ..... 198/330
3,366,217 A * 1/1968 Tosato et al. ..... 198/330
6,427,823 B1 * 8/2002 Ishikawa et al. ..... 198/330
6,702,094 B2 * 3/2004 Ishikawa et al. ..... 198/330
2006/0108196 A1 5/2006 Ishikawa et al.
2007/0007106 A1 1/2007 Ishikawa et al.
2007/0045082 A1 3/2007 Ishikawa et al.

FOREIGN PATENT DOCUMENTS

| | | |
|---|---|---|
| JP | 42 16775 | 9/1967 |
| JP | 42-16775 | 9/1967 |
| JP | 48-81285 | 10/1973 |
| JP | 48 81285 | 10/1973 |
| JP | 58 134369 | 9/1983 |
| JP | 58-134369 | 9/1983 |
| JP | 61 166492 | 7/1986 |
| JP | 2002 128411 | 5/2002 |

* cited by examiner

*Primary Examiner*—James R Bidwell
(74) *Attorney, Agent, or Firm*—Oblon, Spivak, McClelland, Maier & Neustadt, L.L.P.

(57) ABSTRACT

Provided is a passenger conveyor including a plurality of steps (2) having step rollers (6 and 7), a step chain (8) circulatingly moving in conjunction with each of the plurality of steps (2), guide rails (13*a*, 13*b*, 14*a* and 14*b*) provided in an intermediate portion of a truss and guiding the step rollers (6 and 7) of each step (2), and an intermediate driving device (12) provided in the intermediate portion of the truss and configured to transmit a driving force to the step chain (8). A step-attitude changing zone (Z) for changing the attitude of each step (2) on a return path side is provided on the traveling path of the steps (2) on the return path side.

9 Claims, 3 Drawing Sheets

PASSENGER CONVEYOR

TECHNICAL FIELD

The present invention relates to a passenger conveyor having a driving device installed in an intermediate portion of the passenger conveyor. In particular, the present invention relates to a passenger conveyor in which a space for the installation of the driving device is secured.

BACKGROUND ART

A passenger conveyor, such as an escalator and a moving walkway, includes a plurality of steps each provided with step rollers on the front and rear sides thereof. These steps are linked to one another in an endless manner with a step chain. The driving of the step chain causes all the steps to move to circulate between an entrance and an exit in a synchronized manner with no space between each adjacent two steps. In the case of an escalator, each step is guided with the rollers supported on step guide rails installed in a truss while traveling on the forward path side. Accordingly, while a footboard of each step is held horizontal, the step travels in a horizontal direction in a vicinity of the entrance and in a vicinity of the exit, and also travels in an ascending or descending direction inclined at approximately 30° in the intermediate portion extending from the vicinity of the entrance to the vicinity of the exit. The rollers of each step are guided by reverse rails at a returning section in an upstairs section or a downstairs section, so that the traveling direction and the attitude of each step are reversed. On the return path side, each step travels in a state where the rollers of the step are guided by other step guide rails, which are provided downward of the step guide rails on the forward path side in the truss.

As the driving device for driving the step chain linking the steps to one another, often employed is a device which is provided in a machine room in a vicinity of the entrance or the exit on the upstairs side, and which is driven with a sprocket provided in the returning end section of the step chain.

There also is another type of device which is provided in the intermediate portion of the truss, and which is driven with a rack or the like engaged with the step chain. For the driving device installed in the intermediate portion of the truss, a roller reaction force at the returning section of the step chain is constant regardless of the floor height. Accordingly, the driving device of this type is advantageous in that components having certain strength can be used regardless of the floor height.

In the case of an escalator having a high floor height, it has also been proposed to use, in combination, a driving device in which a returning end section of the step chain is driven by a sprocket, and a driving device installed in the intermediate portion of the truss. This is for the following reason. When a floor height is high, a heavy load is imposed on the step chain. Accordingly, with the driving device at the returning end section of the step chain alone, the driving force is sometimes transmitted only insufficiently. In addition, not only in the case of the escalator having a high floor height, but also in the case of a moving walkway having a long traveling distance, with the driving device at the returning end section of the step chain alone, the driving force is sometimes transmitted only insufficiently. For this reason, it has been proposed to distribute, driving devices, each of which can provide a driving force in the middle of a long step chain (a portion other than the end sections where the step chain changes the direction so as to return). This makes it possible to move the long step chain and the series of steps connected to the step chain even in the above-described cases.

Such a passenger conveyor in which a driving device is provided in an intermediate portion of a truss has been disclosed, for example, in Patent Document 1 and Patent Document 2. In Patent Document 1, a drive pinion of a driving device installed in an intermediate portion is engaged with racks formed in link plate portions of a step chain, so that a driving force is transmitted from the driving device to the step chain. In Patent Document 2, a driving force is transmitted from a driving device installed in an intermediate portion of a truss by using a standard step chain instead of a special chain such as a chain with teeth. For achieving this, in the driving device, a rocking unit is attached to a rotary driving device with an eccentric shaft in between while rolling gear teeth, each having a trochoidal shape, are provided to the rocking unit. The rolling gear teeth are engaged with the step chain while the rocking unit performs a rocking movement due to the transmission of the rotational movement of the rotary driving device, so that a driving force is given to the step chain.

Descriptions will be given of the above-described passenger conveyor of the related art, in which a driving device is installed in the intermediate portion, and concurrently in which another driving device is also installed in a machine room in an end portion on the upstairs side. This passenger conveyor includes a plurality of steps each including a footboard on which a passenger stands, a stair riser connected to an end portion of the footboard, front-wheel rollers, and rear-wheel rollers. The front-wheel and rear-wheel rollers are provided to a frame to which the footboard and the stair riser are attached. The front-wheel rollers of each step are connected to an endless step chain at certain pitches. The step chain is looped around a driving wheel provided on the upstairs side and a coupled driving wheel provided on the downstairs side. A driving force is transmitted to the driving wheel from a driving device, so that the step chain moves to circulate between the driving wheel and the coupled driving wheel. Moreover, an intermediate driving device including a motor is installed in an intermediate inclined portion of the passenger conveyor, and is engaged with the step chain to transmit a driving force to the step chain. As the intermediate driving device, the passenger conveyor includes an intermediate driving device which gives a driving force to the step chain by the rocking movement of a rocking unit including rolling gear teeth, as described in Patent Document 2.

In accordance with the circulating movement of the step chain, the steps move to circulate. At this time, the front-wheel rollers are guided by forward-path-side front-wheel guide rails and also by return-path-side front-wheel guide rails, while the rear-wheel rollers are guided by front-path-side rear-wheel guide rails and also by return-path-side rear-wheel guide rails.

The intermediate driving device is arranged between the steps traveling on the forward path and the steps traveling on the return path. In particular, the motor, a reduction mechanism for transmitting the power of the motor and the like are housed in a space sandwiched between the lower end portions of the stair risers of the steps on the forward path side and the lower end portions of the stair risers of the steps on the return path side.

Patent Document 1: Japanese Patent Application Laid-open Publication No. Sho 61-166492

Patent Document 2: Japanese Patent Application Laid-open Publication No. 2002-128441

DISCLOSURE OF THE INVENTION

Suppose a case where a passenger conveyor of a high floor height is to be configured by installing only one driving device in a machine room on the upstairs, and concurrently by increasing the capacity of the driving device. In this case, it is necessary to increase the truss dimensions of the machine room on the upstairs, for installing the driving device with a large capacity. A driving device with a further large capacity, as well as a chain and a driving wheel having enough strength to handle such a driving device, are not widely employable. This leads to problems regarding production cost and availability.

For this reason, in recent years, techniques for installing a plurality of driving devices in an intermediate portion of a passenger conveyor have actively been developed, as have been proposed in Patent Document 1 and Patent Document 2.

However, for installing a plurality of driving devices in the intermediate portion, it is necessary to house components constituting the driving devices, such as a motor and a reduction mechanism, in a space between the steps moving on the forward path side and the steps moving on the return path side.

Accordingly, in the case of the relevant passenger conveyor in which the driving devices are installed in the intermediate portion, it is possible to install, with the conventional truss dimensions, only a driving device with a capacity sufficiently small to be housed in the space between the steps on the forward path side and on the return path side. For this reason, for the purpose of securing a sufficient driving force, only the following methods can be employed. Specifically, the number of driving devices to be installed in the intermediate portion is increased. Alternatively, the space between the steps moving on the forward path side and the steps moving on the return path side is increased by increasing the dimension, in the width direction, of the intermediate portion of the truss so that a driving device with a large capacity to some extent can be installed.

However, an increase in the number of driving devices to be installed in the intermediate portion leads to an increase in production cost, and also to an increase in the amount of work for maintenance. On the other hand, when the dimension, in the width direction, of the intermediate portion of the truss is to be increased, it is required to newly change the design. In addition, it is difficult to modify the structure of the truss of an existing escalator.

The present invention has been made for the purpose of solving the above-described problems associated with the relevant techniques. An object of the present invention is to provide an efficient passenger conveyor of a drive-distributed type, in which an appropriate number of driving devices each having an appropriate capacity can be installed without changing the conventional truss dimensions, and with which the problems are thus solved, such as a high production cost due to an increase in space for installation, or due to an increase in the number of driving devices in the intermediate portion.

For the purpose of achieving the object, a passenger conveyor according to an aspect of the present invention includes: a plurality of steps; step rollers provided to the plurality of steps; a step chain connected to each of the plurality of steps and moving to circulate between two gates; forward-path-side guide rails and return-path-side guide rails provided along a traveling path of the step chain in an intermediate portion of a truss and guiding the step rollers; and an intermediate driving device installed between the steps moving along the forward-path-side guide rails on a forward path side and the steps moving along the return-path-side guide rails on a return path side and configured to transmit a driving force to the step chain, wherein a step-attitude changing zone for changing an attitude of each step on the return path side is formed on a traveling path of the steps on the return path side.

In the passenger conveyor according to the above-described aspect of the present invention, it is possible to install an appropriate number of driving devices each having an appropriate capacity, which is larger than a conventional one, without changing the conventional truss dimension. This is achieved by forming the step-attitude changing zone for changing the attitude of each step on the return path side, on the traveling path of the steps on the return path side in the passenger conveyor in which the driving device is installed in the intermediate portion. As a result, it is possible to constitute an efficient passenger conveyor in which problems, such as a high production cost due to an increase in space for installation or an increase in the number of driving devices in the intermediate portion, are solved.

BEST MODES FOR CARRYING OUT THE INVENTION

Figure 1:
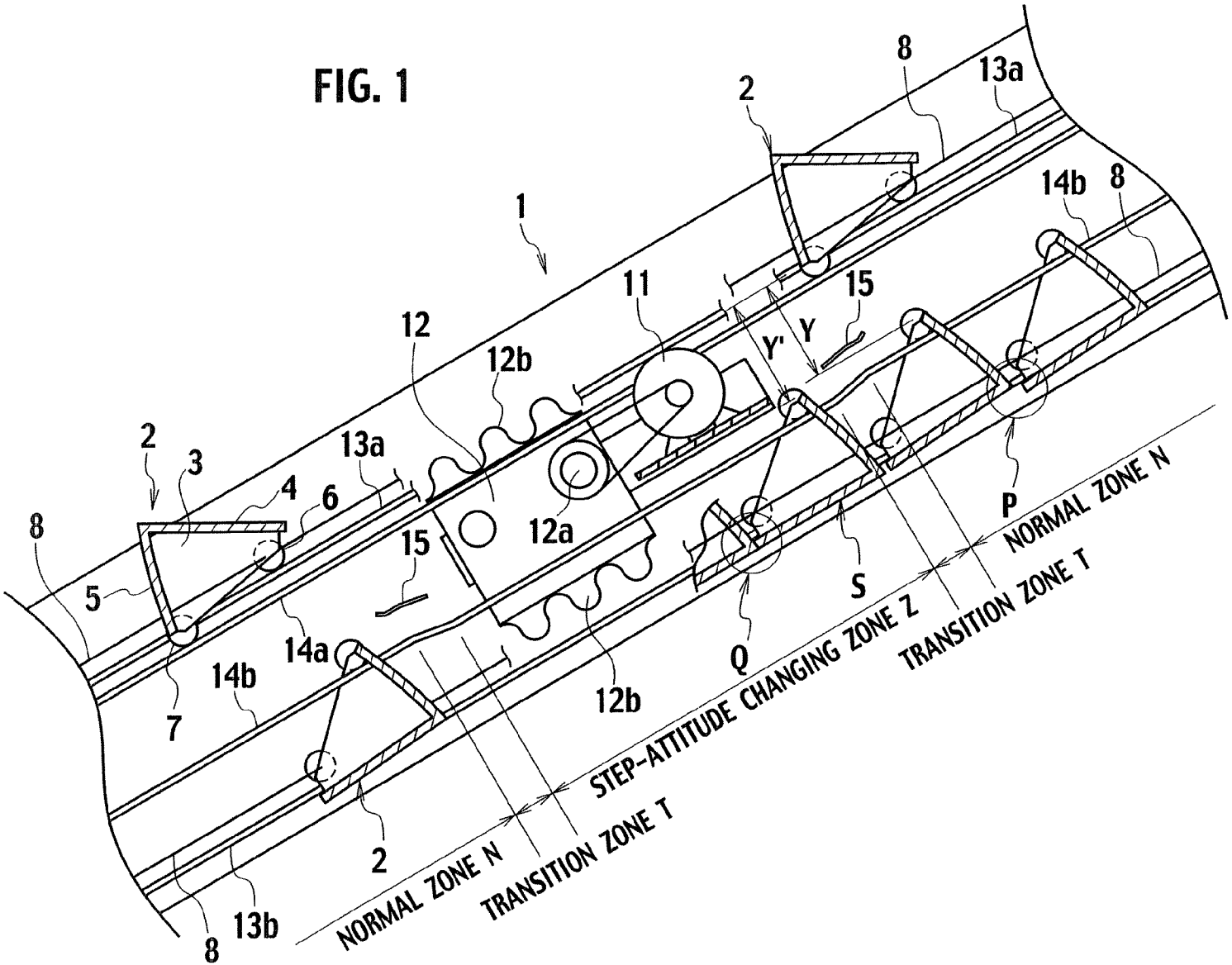
FIG. 1 is a side view showing principal parts around a driving device provided in an intermediate portion of a passenger conveyor according to a first embodiment of the present invention.

Hereinafter, descriptions will be given in detail of a passenger conveyor according to embodiments of the present invention with reference to the drawings. In the descriptions below of the drawings, the same or similar components are denoted by the same or similar reference numerals. The drawings are only schematic, and accordingly it should be noted that the relationships between thicknesses and dimensions in plane, ratios among thicknesses of respective layers, and the like are different from those in reality.

FIRST EMBODIMENT

FIG. 1 is a side view showing an example of an escalator as an a passenger conveyor according to a first embodiment of the present invention, and particularly showing principal parts of and around a driving device provided in an intermediate portion of the escalator.

A passenger conveyor 1 shown in FIG. 1 includes a plurality of steps 2. Each of the steps 2 includes a frame 3, a footboard 4, a stair riser 5, front-wheel rollers 6 and rear-wheel rollers 7. The frame 3 has a side contour of a substantially fan shape. The footboard 4 is attached to the frame 3, and includes a tread on which a passenger stands. The stair riser 5 is attached to an arc portion of the frame 3 while being connected to one end portion of the footboard 4. The front-wheel rollers 6 and the rear-wheel rollers 7 are provided respectively in a vicinity of the front end of the frame 3 and in a vicinity of the rear end of the frame 3, so as to serve as step rollers attached rotatably to the frame 3. The front-wheel rollers 6 of these steps 2 are linked to one another at predetermined pitches with an endless step chain 8.

The step chain 8 schematically shown in FIG. 1 is a chain including pin rollers, and is driven by an intermediate driving device 12 to which a driving force is transmitted from a motor 11. The step chain 8 may be configured to be driven by another driving device provided in an unillustrated machine room on the upstairs side in addition to the intermediate driving device 12.

The intermediate driving device 12 includes an eccentric shaft 12*a* to which the rotational driving force is transmitted from the motor 11. The rotation of the eccentric shaft 12*a* causes the entire intermediate driving device 12 to rock by the same amount of each interval of the pins of the step chain 8. Trochoidal teeth 12*b* are formed on the upper end portion of the intermediate driving device 12 so as to engage the pins of the step chain 8. Accordingly, as the intermediate driving device 12 rocks in accordance with the rotation of the eccentric shaft 12*a*, the driving force is transmitted from the trochoidal teeth 12*b* to the pins of the step chain 8, which pins engage the trochoidal teeth 12*b*. As a result, the step chain 8 is driven. The intermediate driving device 12 described above is the same as that disclosed in Patent document 2. Incidentally, in the passenger conveyor 1 of the present invention, the drive mechanism of the intermediate driving device is not limited to that shown in FIG. 1 or that disclosed in Patent Document 2. Alternatively, it is possible to employ another type of an intermediate driving device having conventionally been used as an intermediate driving device of a passenger conveyor.

In accordance with the circulating movement of the step chain 8, the front-wheel rollers 6 and the rear-wheel rollers 7 of each of the steps 2 are guided respectively by the front-wheel guide rails 13*a* and the rear-wheel guide rails 14*a* on the forward path side. Accordingly, each of the steps 2, which are connected to the step chain 8, travels in a state where the footboard 4 of each step 2 is held in a horizontal position. On the return path side, each of the steps 2 travels while the front-wheel rollers 6 and the rear-wheel rollers 7 are guided respectively by the front-wheel guide rails 13*b* and the rear-wheel guide rails 14*b*.

In the passenger conveyor 1 according to the first embodiment, a step-attitude changing zone Z for changing the attitude of each of the steps 2 on the return path side is formed on the traveling path of the steps 2 on the return path side. The step-attitude changing zone Z is provided in a vicinity of a position where the intermediate driving device 12 is installed. To be specific, the step-attitude changing zone Z is provided in the following manner in terms of the rear-wheel guide rails 14*b*. In a region in a vicinity of the position where the motor 11 and the intermediate driving device 12 are provided in the truss, that is, in the step-attitude changing zone Z shown in FIG. 1, the relative positions of the rear-wheel guide rails 14*b* on the return path side are arranged in the truss at a position lower than the height of the rear-wheel guide rails 14*b* in normal zones on both sides of the step-attitude changing zone Z. In the illustrated embodiment, the degree of the height of the rear-wheel guide rails 14*b* on the return path side is set so as to correspond to a certain height of the rear-wheel rollers 7 of each step (step S in FIG. 1). With this height, the surface of the footboard 4 of each step 2 guided by the rear-wheel and front-wheel guide rails 14*b* and 13*b* on the return path side is caused to have a step attitude substantially parallel to the inclination angle of the passenger conveyor. Furthermore, transition zones T are provided in a manner of connecting each normal zone N and the step-attitude changing zone Z with each other, as regions where the attitude of each step 2 gradually changes in conjunction with the movement of the step 2. In each transition zone T, the rear-wheel guide rails 14*b* are formed of a combination of a gentle slope and curve.

The transition zones T correspond to an entrance and an exit of the step-attitude changing zone Z for the rear-wheel rollers 7. In the transition zones T, pressing rails 15 are provided parallel to the rear-wheel guide rails 14*b*. The pressing rails 15 guide the rear-wheel rollers 7 of each step 2 from the upper side of the rear-wheel rollers 7 so that the rear-wheel rollers 7 can smoothly travel during the transit from the normal zone N to the step-attitude changing zone Z along the rear-wheel guide rails 14*b*, or from the step-attitude changing zone Z to the normal zone N.

Figure 2:
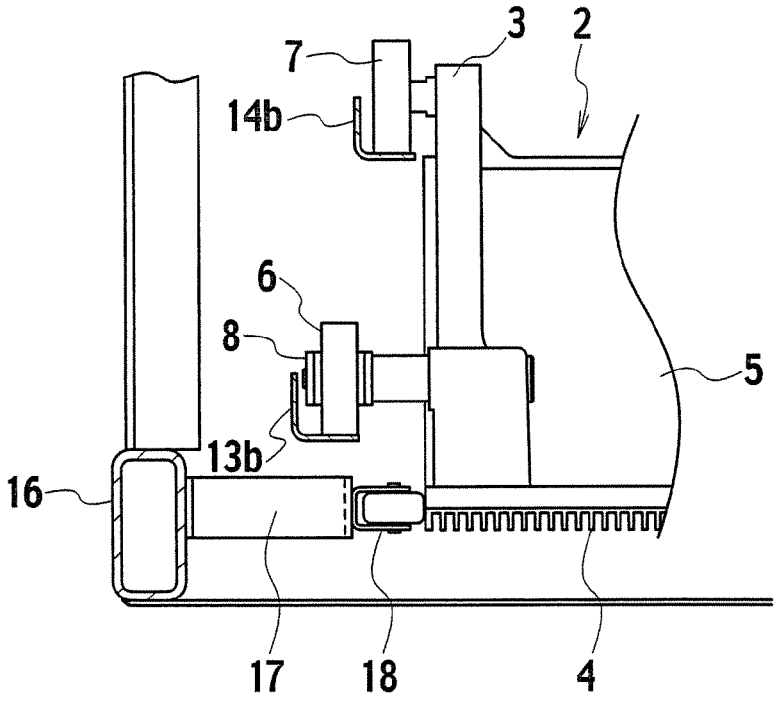
FIG. 2 is a cross-sectional view of a part, on a return path side, of a step-attitude changing zone of the passenger conveyor according to the first embodiment of the present invention.

FIG. 2 shows a cross-sectional view of a part of the step-attitude changing zone Z on the return path side. In FIG. 2, the front-wheel rollers 6 of the step 2 are guided by the front-wheel guide rails 13*b* while rolling, in accordance with the circulating movement of the step chain 8. In the same manner, the rear-wheel rollers 7 are also guided by the rear-wheel guide rails 14*b* while rolling. A truss member 16 serves as an outer frame of the passenger conveyor. Fixing members 17 are provided to protrude from the truss member 16 toward the side faces of the footboard 4 of the step 2. In addition, a guide roller 18 is provided to the tip end of each fixing member 17 in a manner of abutting on the corresponding side face of the footboard 4, or of being adjacent to the side face with some space in between. The guide rollers 18 are each provided so as to face both side faces of the footboard 4, and also one or a plurality of the guide rollers 18 are provided along the traveling direction of the steps.

Hereinafter, descriptions will be given of the effects of the first embodiment shown in FIG. 1 and FIG. 2.

Firstly, in the passenger conveyor 1 shown in FIG. 1, when the driving force is transmitted from the intermediate driving device 12 to the step chain 8, the step chain 8 moves to circulate. At this time, on the forward path side, the steps 2 are guided by the front-wheel guide rails 13*a* and the rear-wheel guide rails 14*a* so as to travel between the upstairs and the downstairs while the footboard 4 of each step 2 is caused to hold a step attitude parallel to the floor surface all the time.

On the other hand, in the normal zones N on the return path side, the steps 2 are guided by the front-wheel guide rails 13*b* and the rear-wheel guide rails 14*b* on the return path side. Each adjacent two steps 2, connected to each other, travel in a state where the front end portion of the following one of the two steps 2 and the rear end portion of the preceding one of the two steps 2 are in the step attitude so as to be spaced apart from each other (P in FIG. 1) due to the positional relationship of the front-wheel guide rails 13*b* and the rear-wheel guide rails 14*b*.

The height of the rear-wheel guide rails 14*b* on the return path side is relatively arranged lower in the step-attitude changing zone Z than in the normal zones N as described above. Accordingly, when each step 2 travels into the step-attitude changing zone Z through the transition zone T, the attitude of the footboard 4 of each step 2 is changed to be substantially parallel to the inclination angle of the passenger conveyor 1. The footboard 4 of each step 2 thus passes through the vicinity of the intermediate driving device 12 while holding the attitude.

At this time, the rear-wheel rollers 7 are guided not only by the rear-wheel guide rails 14*b*, but also by the pressing rails 15 provided in the transition zone T, from the upper side of the rear-wheel rollers 7. Accordingly, the rear-wheel rollers 7 are forced to follow the rear-wheel guide rails 14*b* on the return path side, so that the step 2 can surely change the attitude thereof.

In the step-attitude changing zone Z, since the guide rollers 18 are disposed to abut on, or to be adjacent to, the footboard 4 as shown in FIG. 2, the step 2 is restrained by the guide rollers 18 so as not to move in the width direction. Accordingly, each footboard 4 formed in a comb-like shape on the surface of the step 2 moves always in a state of engaging cleats of the footboards 4 of the preceding and following steps (Q in FIG. 1).

As described above, in the passenger conveyor 1 according to the first embodiment, the space between the steps 2 on the forward path side and the steps 2 on the return path side is formed larger in the step-attitude changing zone Z than in the normal zones N, in comparison with the passenger conveyors of the related art. In other words, the dimension that is equivalent to the dimension Y of the space in the normal zone N in the case of the relevant passenger conveyors is increased to the dimension Y' in the step-attitude changing zone Z in FIG. 1. Accordingly, a space for installing the intermediate driving device 12 and the motor 11 for driving the intermediate driving device 12 is increased. For this reason, according to the first embodiment, a large space can be created between the steps 2 on the forward path side and the steps 2 on the return path side in the passenger conveyor 1 where the intermediate driving device 12 is installed in the intermediate portion. This makes it possible to install the intermediate driving device 12 including a motor with a large capacity, and to thus drive, with a small number of driving devices, steps of a passenger conveyor of a higher floor height. As a result, there are advantages, such as cost reduction and reduction in time for adjustment and maintenance of the driving devices because the number of driving devices can be reduced.

Since there is no need for increasing the depth of the truss, it is possible to prevent an increase in the space for installment. For this reason, the present invention can be employed to conventionally-used passenger conveyors.

The step-attitude changing zone Z can be achieved by modifying the rear-wheel guide rails 14*b* without changing the height of the front-wheel guide rails 13*b* on the return path side. Accordingly, a large effect can be obtained with respect to the amount of work required for the modification.

The height of the rear-wheel guide rails 14*b* in the step-attitude changing zone Z is configured so that the surface of the footboard 4 of each step 2 can have an attitude substantially parallel to the inclination angle of the passenger conveyor 1 when the rear-wheel rollers 7 of each step 2 on the return path side are guided by the rear-wheel guide rails 14*b*. This allows the conventionally-used steps 2 to be used as they are.

The transition zone T is provided between the step-attitude changing zone Z and each of the normal zones N. This makes it possible to cause each step 2 to smoothly transit from the normal zone N to the step-attitude changing zone Z, and also from the step-attitude changing zone Z to the normal zone N, while being guided by the rear-wheel guide rail 14*b*.

Since the pressing rails 15 are disposed, the rear-wheel rollers 7 are forced to follow the rear-wheel guide rails 14*b* on the return path side when each step 2 transits from or to the step-attitude changing zone Z. Accordingly, each step 2 can surely change the attitude.

In the step-attitude changing zone Z, the footboard 4 formed in the comb shape (with the cleats formed therein) on the surface of each step 2 always moves in the state of engaging the cleats of the footboard 4 (Q in FIG. 1) of each of the preceding and following steps 2. As shown in FIG. 2, the steps 2 are restrained by the guide roller 18 so as not to be displaced in the width direction. Accordingly, the adjacent preceding and following steps do not move relative to each other in the width direction. As a result, the comb-shaped portions engaging each other are not brought into contact with each other to be broken.

SECOND EMBODIMENT

Figure 3:
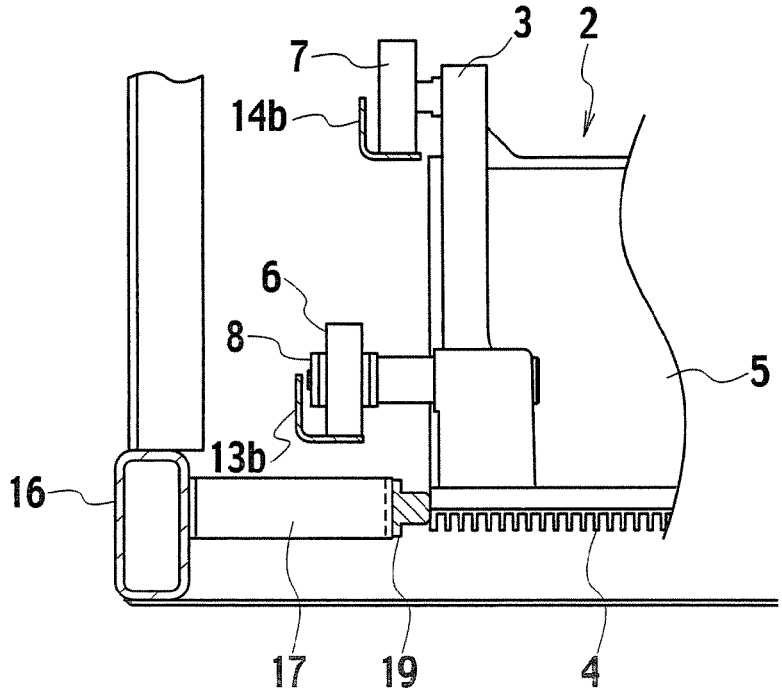
FIG. 3 is a cross-sectional view of a part, on a return path side, of a step-attitude changing zone of a passenger conveyor according to a second embodiment of the present invention.

FIG. 3 shows a cross-sectional view of a part, on a return path side, of a step-attitude changing zone Z of a passenger conveyor according to a second embodiment of the present invention.

In FIG. 3, the same members as those in FIG. 2 showing the first embodiment are denoted by the same reference numerals, and redundant descriptions will be omitted below.

In the passenger conveyor of the second embodiment shown in FIG. 3, the fixing members 17 are provided to the truss member 16 to extend toward the side faces of the footboard 4 of each step 2. In addition, a guide member 19 is provided to the tip end of each fixing member 17 in a manner of abutting on the corresponding side face of the footboard 4, or of being adjacent to the corresponding side face of the footboard 4 with some space in between. The guide member 19 is formed of a low frictional resin or the like, which is a low frictional material. Each of the guide members 19 is provided so as to face both side surfaces of the footboard 4 of the step 2, and also one or a plurality of the guide members 19 are provided along the traveling direction of the steps 2.

In the second embodiment shown in FIG. 3 as well, the step-attitude changing zone Z as shown in FIG. 1 is provided. The provision of the step-attitude changing zone Z provides the same effects as those of the first embodiment.

In the second embodiment shown in FIG. 3, the guide members 19 restrain the displacement of each step 2 in the width direction. Accordingly, as in the case of the first embodiment, the comb-shaped portions, which engage each other, of the adjacent preceding and following steps are not brought into contact with each other to be broken.

THIRD EMBODIMENT

Figure 4:
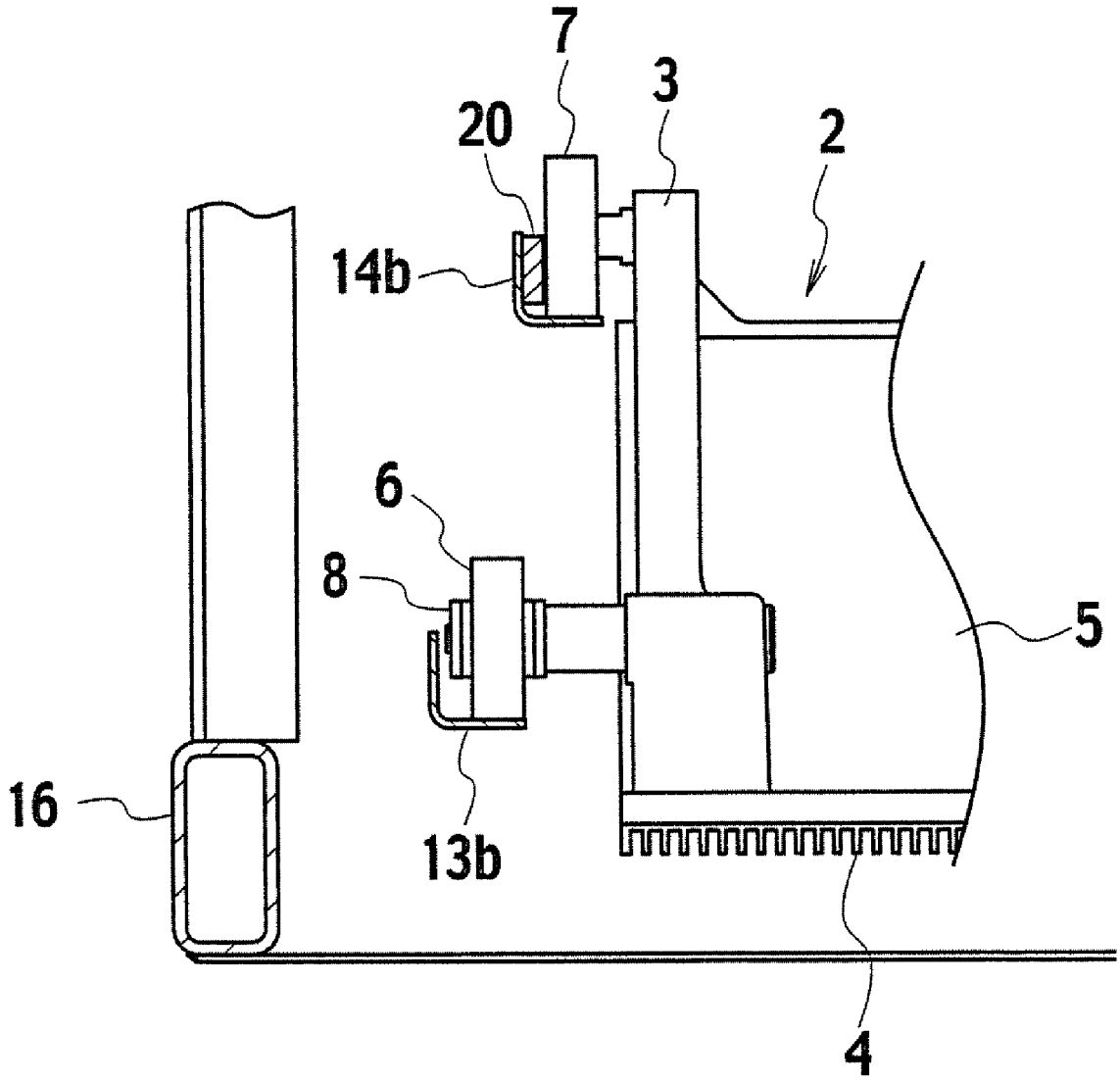
FIG. 4 is a cross-sectional view of a part, on a return path side, of a step-attitude changing zone of a passenger conveyor according to a third embodiment of the present invention.

FIG. 4 shows a cross-sectional view of a part, on a return path side, of a step-attitude changing zone Z of a passenger conveyor according to a third embodiment of the present invention.

In FIG. 4, the same members as those in FIG. 2 and FIG. 3 are denoted by the same reference numerals, and redundant descriptions will be omitted below.

In FIG. 4, a plate member 20 is attached to the side face of the rear-wheel guide rail 14*b* on the return path side. The plate member 20 is formed of a low frictional resin or the like, which is a low frictional material, and also is arranged in a manner of abutting on the rear-wheel rollers 7 of the step 2, or of being adjacent to the rear-wheel rollers 7 with some space in between. The plate members 20 are provided so as to face both side surfaces of the footboard 4 of the step 2, and also one or a plurality of the plate members 20 are provided along the traveling direction of the steps 2.

In the third embodiment shown in FIG. 4 as well, the step-attitude changing zone Z as shown in FIG. 1 is provided. The provision of the step-attitude changing zone Z provides the same effects as those of the first embodiment.

Since the plate members 20 are provided, the plate members 20 restrain the displacement of each step 2 in the width direction with the rear-wheel rollers 7 of the step 2 in between. Accordingly, as in the cases of the first embodiment and the second embodiment, the comb-shaped portions, which engage each other, of the adjacent preceding and following steps 2 are not brought into contact with each other to be broken.

As above, the present invention has been described by taking up the first to third embodiments. However, the present invention is not limited to these embodiments, and various modifications may be made on each of these embodiments without departing from the scope of the present invention.

INDUSTRIAL APPLICABILITY

According to the present invention, an intermediate driving device with an adequate capacity can be installed in a passenger conveyor without changing conventional truss dimensions. This makes it possible to provide an efficient passenger conveyor of a drive distributed type, in which problems, such as a high production cost due to an increase in space for installation or an increase in the number of driving devices in the intermediate portion, are solved.

The invention claimed is:

1. A passenger conveyor comprising:

a plurality of steps;

step rollers provided to the plurality of steps;

a step chain connected to each of the plurality of steps and moving to circulate between two gates;

forward-path-side guide rails and return-path-side guide rails provided along a traveling path of the step chain in an intermediate portion of a truss and guiding the step rollers; and an intermediate driving device installed between the steps moving along the forward-path-side guide rails on a forward path side and the steps moving along the return-path-side guide rails on a return path side and configured to transmit a driving force to the step chain, wherein a step-attitude changing zone for changing an attitude of each step on the return path side is formed on a traveling path of the steps on the return path side, wherein the step attitude changing zone is formed in a manner that, among the return-path-side guide rails, part of the return-path-side guide rails for guiding rear wheels of the step rollers is arranged in a position lower than the position of the other part thereof in a normal zone, which is a zone on the return path side other than the step-attitude changing zone.

2. The passenger conveyor according to claim 1, wherein the step-attitude changing zone is provided in a vicinity of a position where the intermediate driving device is installed.

3. The passenger conveyor according to claim 1, wherein height of the return-path-side guide rails for guiding the rear wheels of the step rollers in the step-attitude changing zone is arranged, so that surface of a footboard of each step having the rear wheels of the step rollers guided by the return-path-side guide rails has a step attitude substantially parallel to an inclination angle of the passenger conveyor.

4. The passenger conveyor according to claim 1, wherein a transition zone is provided between the step-attitude changing zone and the normal zone, and wherein, in the transition zone, the return-path-side guide rails for guiding the rear wheels of the step rollers are formed in a gentle slope or a gentle curve, connecting the step-attitude changing zone and the normal zone with each other.

5. The passenger conveyor according to claim 1, wherein pressing rails guiding the rear wheels of the step rollers on the return path side from the upper side of the rear wheels are provided in at least an entrance and an exit, of the step-attitude changing zone.

6. The passenger conveyor according to claim 1, wherein a displacement preventing mechanism preventing displacement of each step in a width direction is provided in the step-attitude changing zone.

7. The passenger conveyor according to claim 6, wherein the displacement preventing mechanism is a plurality of rollers provided in a manner of abutting on, or of being adjacent to, with some space in between, the side faces of each step.

8. The passenger conveyor according to claim 6, wherein the displacement preventing mechanism is guide members including a low frictional material and provided in a manner of abutting on, or of being adjacent to, with some spaces in between, the side faces of each step.

9. The passenger conveyor according to claim 6, wherein the displacement preventing mechanism is plate members including a low frictional material and provided in a manner of abutting on, or of being adjacent to, with some spaces in between, front wheels or the rear wheels of the step rollers.

* * * * *